United States Patent [19]

Jayne et al.

[11] 4,106,838

[45] Aug. 15, 1978

[54] STACKABLE FLAT CABLE CONNECTOR AND CONTACT THEREFOR

[75] Inventors: Max Leroy Jayne, North Warren; Robert Stephen Orbanic, Warren; Scott Jack Lapraik, Pleasantville, all of Pa.

[73] Assignee: GTE Sylvania Inc., Stamford, Conn.

[21] Appl. No.: 783,070

[22] Filed: Mar. 30, 1977

[51] Int. Cl.[2] ..... H01R 9/08

[52] U.S. Cl. ..... 339/99 R; 339/176 MF

[58] Field of Search ..... 339/17 F, 97 R, 97 P, 339/98, 99 R, 176 M, 176 MF, 176 MP

[56] References Cited

U.S. PATENT DOCUMENTS

| | | | |
|---|---|---|---|
| 3,434,093 | 3/1969 | Wedekind | 339/176 MF |
| 3,680,032 | 7/1972 | Mosier | 339/17 F |
| 3,713,072 | 1/1973 | Henschen | 339/17 F |
| 3,874,764 | 4/1975 | Volinskie | 339/97 R |
| 4,027,941 | 6/1977 | Narozny | 339/98 |
| 4,030,799 | 6/1977 | Venaleck | 339/99 R |

*Primary Examiner*—Neil Abrams

*Attorney, Agent, or Firm*—Robert E. Walter; John C. Fox

[57] ABSTRACT

A stackable connector assembly adapted to receive a flat cable having a plurality of aligned conductors and to be plugged into an array or grid of conductor pins and to interconnect the cable conductors and pin conductors, comprises a top body mounting two rows of contacts on its lower face wherein the conductor-engaging portions of the contacts are offset by rows and a bottom body having openings therein configured to receive a portion of the contacts upon assembly of the connector. The upper face of the bottom body is configured to position the flat cable so that when the top and bottom bodies are assembled the tubular bodies of the contacts in each row will spread and pass between adjacent conductors in the cable, and an offset contact receiving portion having a slot into which the conductor bared of insulation comes to rest will conductively engage them in alternating succession.

Interconnection is achieved by passage of the conductor pins in the grid through the tubular bodies of the contacts. Extension of the pins beyond the upper face of the top body allows stacking by plugging additional connectors onto the extended pin array, thereby interconnecting additional flat cable conductors to pin conductors.

8 Claims, 8 Drawing Figures

STACKABLE FLAT CABLE CONNECTOR AND CONTACT THEREFOR

BACKGROUND AND SUMMARY OF THE INVENTION

The present invention relates to a stackable connector assembly for electrical interconnections of a conductor pin array or grid to a flat multi-conductor cable, having top and bottom bodies of insulative material which are adapted to be held together with the flat cable held therebetween.

The trend in modern electrical and electronics work is the use of all types of multi-conductor cards, plugs, boards and the like. Thus, there is always the problem of proper connections and terminations. In the type of connector used in conjunction with flat multi-conductor cables, it is usual for one of the two body members to carry the contacts which pierce the insulation and establish conductivity with the conductors. In most instances the piercing takes place before the two connector bodies are firmly clamped together, thus the problem of alignment is ever present. Further, the problem of obtaining desired electrical contact in the piercing procedure can be troublesome. This is particularly bothersome in dealing with large numbers of conductors in a small space. In addition, virtually none of the usual two part connectors are stackable.

In view of the foregoing it is an object of this invention to provide a two part connector wherein one part carries the contacts which pierce and make contact prior to complete assembly of the two connector parts and yet achieve one hundred percent alignment and proper contact.

It is a further object to provide a two part connector which in assembled operative condition is vertically stackable.

It is another object of this invention to provide a two part connector assembly having two rows of contacts wherein when the two parts are brought together with the flat cable therebetween the contacts in each row will conductively engage in alternating succession the conductors in the flat cable.

It is another object of this invention to provide a connector assembly having tubular contacts adapted for conductive engagement with conductor pins of an array or grid, whereby interconnection of the pins and flat cable conductors is achieved.

It is yet another object of this invention to provide for extension of the pins beyond the upper surface of the assembly, whereby additional connector assemblies may be stacked to conductively engage extended portions of the pins, whereby interconnection of the pins with additional flat cable conductors is achieved.

The above and additional objects and advantages will become more apparent when taken in conjunction with the following detailed description and drawings.

IN THE DRAWINGS

FIG. 1 is an elevational view partly in section illustrating the connector in assembled form with the flat cable therein and the manner in which the contact engages the cable conductor, and conductor pin, FIG. 2 is a top plan view of the upper surface of the top body of the connector showing in dotted lines the relative positions of the contacts in the assembled unit, FIG. 3 is a plan view of the bottom surface of the top body of the connector after being rotated 180° and illustrates the positioning of the contact receiving openings, FIG. 4 is a plan view of the upper surface of the bottom body of the connector showing the relative positioning of the contact receiving openings, FIG. 5 is a plan view of the bottom surface of the bottom body of the connector after being rotated 180°, FIG. 6 is a cross sectional view taken along line 6—6 of FIG. 1 showing the manner in which the contacts fit within the top and bottom bodies of the connector, FIG. 7 is a perspective view of the contact used in this connector, and FIG. 8 is another perspective view of the contact taken at a different angle from that of FIG. 7 illustrating further details of the contact body.

DETAILED DESCRIPTION

Figure 1:
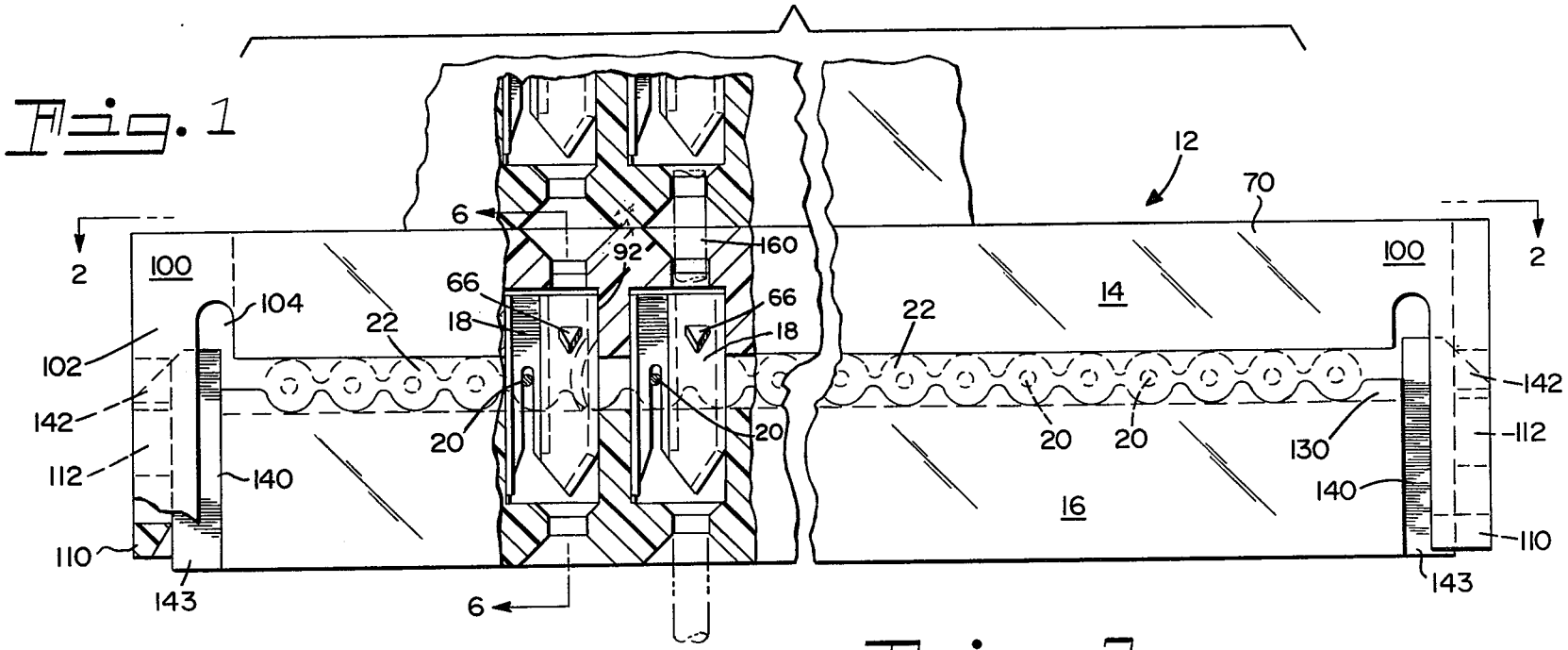

Referring to FIG. 1 wherein the connector is shown in assembled form with the flat cable therein, the connector 12 comprises a top body 14 and a bottom body 16 with a plurality of contacts 18 adapted to conductively engage the conductors 20 in flat cable 22.

In view of the fact that the shape and arrangement of the details of the top and bottom bodies 14 and 16 are dependent upon the configuration of the contact 18 a detailed description thereof follows. For a full disclosure of the contact 18 reference will be made to FIGS. 1, 2, and 6–8. The contact 18 comprises a rectangular tubular body 30, said body having a front wall 32, a back wall 34 and connecting sides 36 and 38. The body top 40 forms a flat planar surface while a tapered foot 42 extends downwardly from the body side 36 and a tapered foot 44 projects downwardly from body side 38.

An offset conductor receiving portion 46 projects outwardly from the body back 34 and includes a pair of parallel web sections 48 and 50 projecting outwardly from the body back 34. Each of webs 48 and 50 is slotted to form a conductor receiving slot 52 which is open only at the bottom to provide entrance for the conductor 20. Flanges 56 and 58 extend from webs 48 and 50, respectively, in diametrically opposite directions to form a generally planar surface. A conductor pin-engaging element 60 is struck from the front 32 of the body 30 and extends inwardly thereinto. The flanges 56 and 58 have somewhat tapered ends 62 and 64, respectively, terminating such that they are generally coextensive with tapered feet 42 and 44. See FIG. 6. Retaining barbs 66 are struck outwardly from body sides 34 and 36 to hold the contacts in position in the top body 14.

Figure 2:
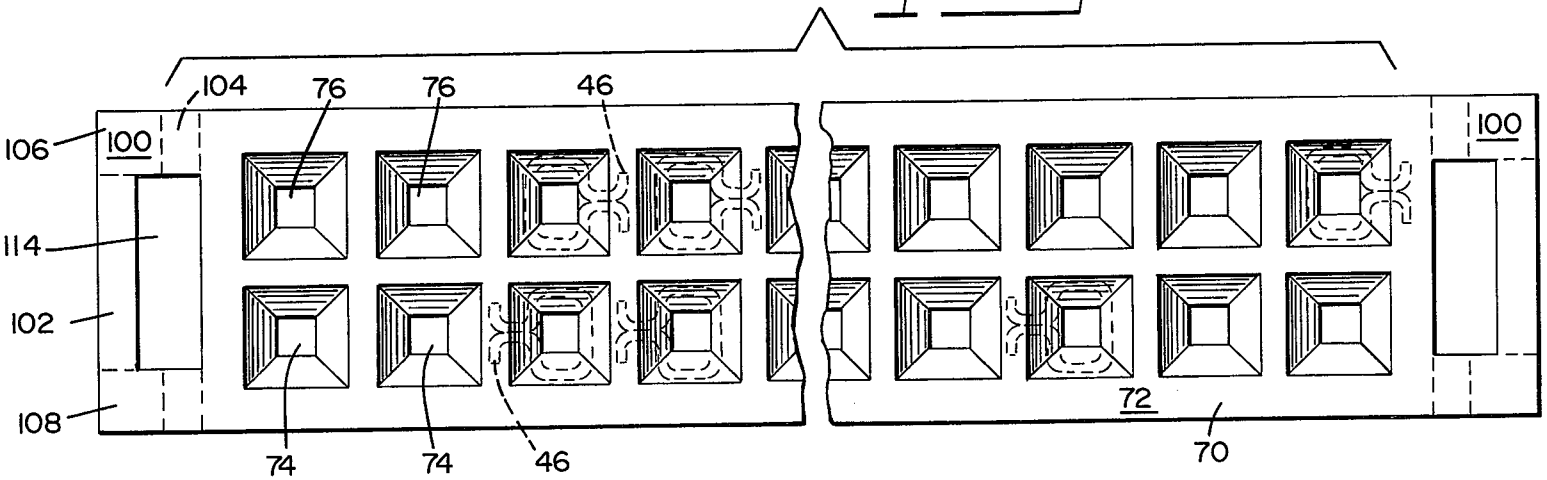

The top body 14 mounts the contacts 18 in two parallel rows as shown in FIG. 2 and comprises a rectangular block 70 having an upper face 72 provided with two rows of aligned rectangular contact receiving openings 74 and 76. It should be noted that the openings 74 and 76 are also in alignment with each other for receiving conductor pins 160 from a grid or array. These conductor pins 160 are conductively connected to the conductors of a flat cable 22 which are offset with respect to such openings. This is accomplished by offsetting the conductor receiving portions 46 of one row of contacts in one direction and offsetting the other row in the opposite direction. See FIG. 2 wherein the contacts 18 are shown in dotted lines and have their contact receiving portions facing opposite directions.

Figure 3:
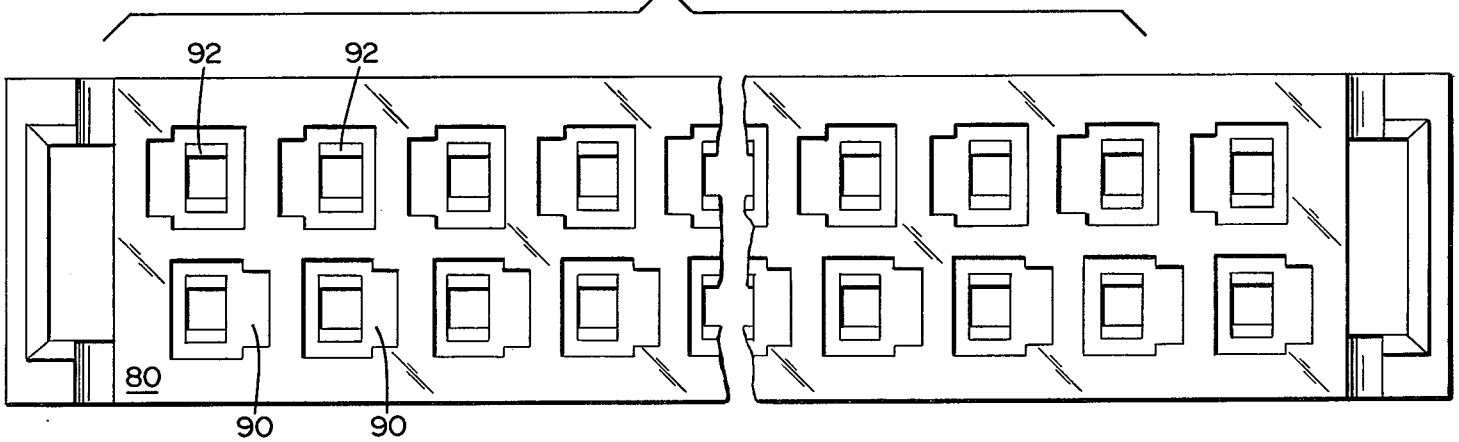
Figure 4:
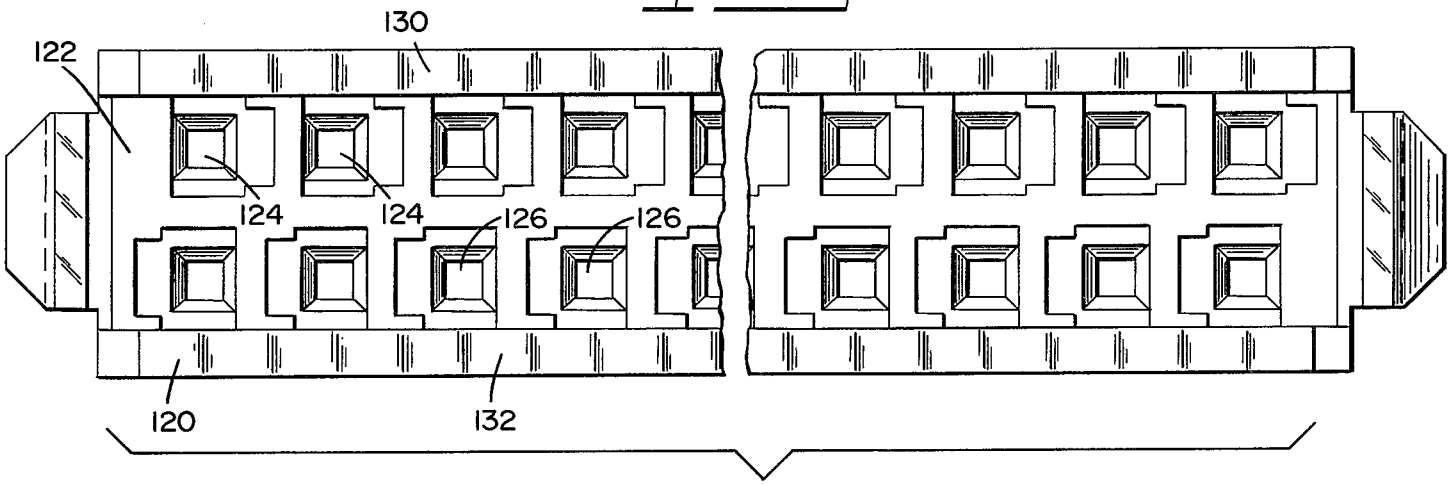

The above is accomplished (see FIG. 3) by providing the bottom portion 80 of the top body 14 with contact receiving holes 90 and 92 which are sized and configured to receive contacts 18 and to dispose them in the manner illustrated in FIG. 2 in dotted lines. More explicitly, upon referring to FIG. 1 it will be clear just how contact 18 is fitted into contacting receiving hole 90 in the top body 14. The contact 18 is pushed into hole 90 so that barbs 66 will engage the wall of the hole 90 to prevent withdrawal of the contact 18 after insertion. See FIG. 6 for this arrangement.

Each end of the top body 14 is provided with an integral and slightly resilient keeper 100 comprising a rectangular member 102 integral with the rectangular body 70 and extending downwardly therefrom. Some resilience is provided by means of relief slot 104 so that the member 102 may swing slightly outward. Member 102 is formed of two vertical legs 106 and 108 connected by cross locking bars 110 and 112. Added flexibility is provided by rectangular opening 114 in the top portion of member 102.

Figure 5:
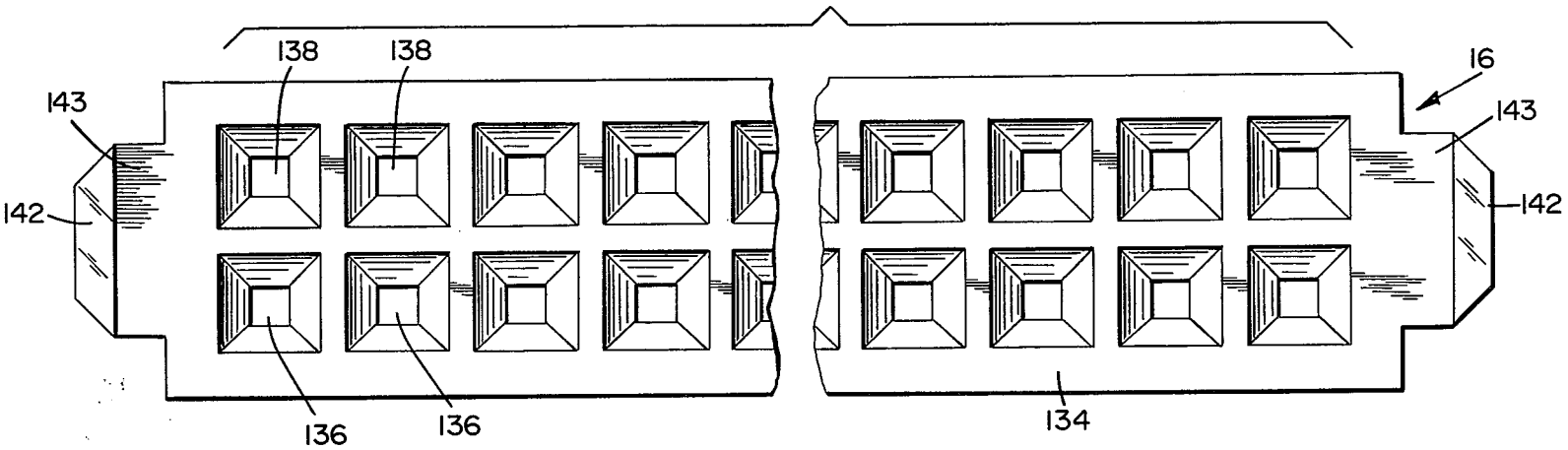
Figure 8:
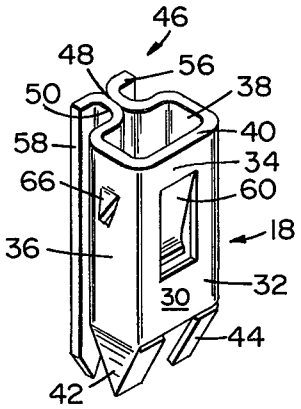
Figure 7:
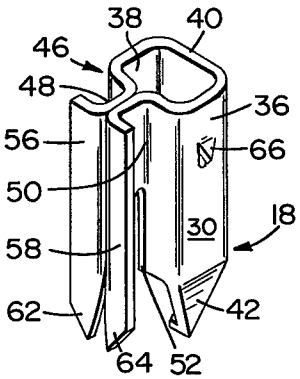
Figure 6:
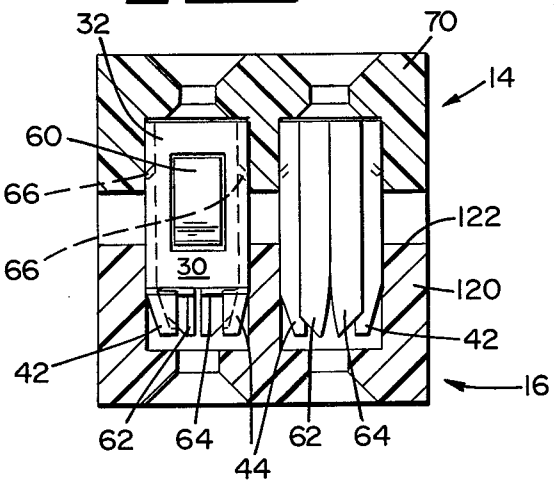

The bottom body 16 is best illustrated in FIGS. 1, and 4–6 and includes a rectangular block or body 120 having an upper face 122 provided with two rows of aligned openings 124 and 126 shaped and sized to accomodate the lower portion of contacts 18 as shown in FIGS. 1 and 6. The offset portions of these openings are adapted to receive the offset conductor receiving portion 46 of contact 18. Further, these openings 124 and 126 are positioned to align with respective openings 90 and 92 in the top body 14 when these two bodies are assembled. The opposite and upper edge portions 130 and 132 of the body 120 are configured so as to conform to the shape and size of the flat cable that is positioned therein.

Referring to FIG. 5, the lower face 134 of the bottom body 16 is provided with two rows of aligned holes 136 and 138 which are aligned and in registration with openings 124 and 126 in the upper side of the bottom body 16. Additionally the bottom body 16 is provided with upwardly extending latch 143 on both ends. The latch 143 comprises a vertically extending arm 140 having an outwardly projecting latch 142 at its upper end which is adapted to engage locking bar 112, as shown in FIG. 1, to hold the top and bottom bodies in assembled condition.

In use, with the contacts 18 assembled in the lower portion of the top body 14 so that they are perfectly oriented as shown in FIGS. 1 and 2, a flat cable is introduced and properly positioned on the upper face of the bottom body 16 so that the flat cable fits down into the appropriately shaped upper edge portions 130 and 132 to assure proper alignment of the cable conductors 20 with the contacts 18. Next, the top body 14 is pushed into engagement with the bottom body 16 whereby the two bodies are aligned so that the tapered feet 42 and 44 of each contact will be properly aligned between cable conductors 20. Continued movement of the top body 14 causes the tapered feet of the contacts to pierce the insulation surrounding the conductors, separating the conductors and forcing them around the tubular bodies of the contacts so that finally the two bodies are assembled and are in the position illustrated in FIG. 1 wherein the conductors 20 have been freed of insulation by the offset portions of the contacts and fit into slots 52 and the latches 142 have engaged the locking bars 112 to hold the connector in operative assembled condition. As shown in FIG. 1, the assembled connector may then be plugged into an array or grid of upstanding conductor pins 160. Furthermore, in accordance with the stackable feature of the connector assemblies, further connectors may be "stacked" by plugging them into the portion of the grid or array extending beyond the upper surface 72 of connector 12. A cut away portion of such a connector is shown associated with pin 160 in FIG. 1.

With regard to materials, the top and bottom bodies are made of a suitable insulative material. One material used for this purpose is glass-fortified polyester. The contacts must be made of an electrically conductive material, one such example being a phosphor bronze alloy. If conditions warrant the contact may be coated with gold or other highly conductive material.

While there has been shown and described what are at present considered the preferred embodiments of the invention, it will be obvious to those skilled in the art that various changes and modifications may be made therein without departing from the scope of the invention as defined by the appended claims.

What is claimed is:

1. A stackable connector assembly adapted to receive a flat cable having a plurality of parallel conductors, said connector assembly comprising:

a. a top body and a bottom body of insulative material, each having a confronting face portion, said top body mounting two rows of contacts, said bottom body adapted to position the flat cable whereby the top and bottom bodies are assembled together the contacts in each row will conductively engage in alternating succession the conductors in the flat cable, b. the confronting face portions of the top and bottom bodies are provided with two rows of openings configured and sized to receive a portion of each contact with the offset portions of the contacts in one row facing one side and the offset portions of the contacts in the row facing in the opposite direction, c. the contacts comprising a tubular body and an offset conductor receiving portion extending outwardly from said body, whereby contacts in one row have the offset portion facing towards one side and the contacts in the other row have their contacts facing the opposite direction, d. the top and bottom bodies having openings to provide conductor pin access to the tubular body of each contact and further wherein these openings are in alignment from row to row and top to bottom, whereby the connector assembly may be plugged into an array of upstanding conductor pins, thereby interconnecting the cable conductors with the conductor pins.

2. The invention as set forth in claim 1 and wherein means are provided to hold the top and bottom bodies in assembled condition with the flat cable therebetween.

3. The invention as set forth in claim 1 and wherein the bottom body is provided with means to align the flat cable with the contacts carried in the top body.

4. The invention as set forth in claim 3 and wherein the means to align the flat cable comprises an undulating section on the upper face of the bottom configured to correspond to that of the flat cable to be carried therein.

5. A contact particularly adapted for use in a multi-contact assembly, said contact comprising:

a rectangular tubular body having a front, a back and connecting sides, an offset conductor receiving portion projecting outwardly from the body and having parallel web portions extending outwardly from the body back, said parallel webs having a flange extending from the end portion of each web in diametrically opposite directions, said projecting portion further having a conductor receiving slot open at its bottom and closed at its top and extending in the same verticality as the longitudinal axis of the tubular body, and means on the tubular body for establishing conductivity between the body and a conducting pin adapted for introduction thereinto.

6. The invention as set forth in claim 5 and wherein the rectangular tubular body has a tapered foot extending downwardly from the bottom of each body side.

7. The invention as set forth in claim 5 and wherein the means on the tubular body for establishing conductivity between the body and a conducting pin adapted for introduction thereinto comprises a wall portion struck from the body.

8. The invention as set forth in claim 6 and wherein the body sides are provided with means adapted to engage the walls of a hole receiving said means to prevent withdrawal of the contact.

* * * * *